US006712935B2

(12) United States Patent
Goodall et al.

(10) Patent No.: US 6,712,935 B2
(45) Date of Patent: Mar. 30, 2004

(54) METHOD AND ARRANGEMENT IN TAIL THREADING IN A PAPER MACHINE

(75) Inventors: Paul Goodall, Wirral (GB); Kari Rinneheimo, Muurame (FI); Jouko Villa, Jyvaskyla (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/044,399

(22) Filed: Nov. 7, 2001

(65) Prior Publication Data

US 2002/0062937 A1 May 30, 2002

(30) Foreign Application Priority Data

Nov. 17, 2000 (FI) ..... 20002532

(51) Int. Cl.[7] ..... D21F 7/00
(52) U.S. Cl. ..... 162/193; 162/255; 162/286
(58) Field of Search ..... 162/193, 255, 162/286; 226/12, 91, 93; 34/113–117, 120

(56) References Cited

U.S. PATENT DOCUMENTS 4,474,643 A * 10/1984 Lindblad ..... 162/198
5,557,860 A * 9/1996 Kotitschke et al. ..... 34/117
6,022,452 A * 2/2000 Caspar ..... 162/286
6,444,090 B1 * 9/2002 Wolf et al. ..... 162/135

FOREIGN PATENT DOCUMENTS

DE 3741680 A * 6/1989
DE 10024295 11/2001

* cited by examiner

*Primary Examiner*—Peter Chin
(74) *Attorney, Agent, or Firm*—Fildes & Outland, P.C.

(57) ABSTRACT

A method and an arrangement in tail threading in a paper machine, in which the paper web is dried in production by means of a plurality of dryer groups consisting of a dryer section, and in which tail threading the threading tail is cut, taken as wetted to the finishing device, and spread to its full width for production, and in which method, before the threading tail is take to the finishing device, the dryer section is kept in the settings of production operation or is set to otherwise correspond to production, except that a wetting process is started, in which the web is wetted at the full width for the duration of the tail threading, essentially before its cutting, to achieve an even moisturizing effect, and the wetting process is stopped after web is being spread.

13 Claims, 2 Drawing Sheets

METHOD AND ARRANGEMENT IN TAIL THREADING IN A PAPER MACHINE

FIELD OF THE INVENTION

This invention relates to a method and arrangement in tail threading in a paper machine, in which the paper web is dried in production by means of a plurality of dryer groups forming a dryer section, and in which, in the tail threading, the threading tail is cut, taken as wetted to the finishing device and spread to its full width for production.

BACKGROUND OF THE INVENTION

Web breaks in a paper machine lead to a need to rapidly restart production. If production is started by taking the tail end of the web from the drier section to the finishing device, tail threading problems arise, particularly in overdried newsprint, LWC- and SC-paper machines, where the moisture content of the paper is 2.5%–4.0%. The problems are caused by the manufacturing process requirements for the paper grades in question. The web is overdried, to allow it to be profiled to an even quality. Overdrying causes shrinking tensions in the CD-direction i.e. cross direction tension to the web.

When using machines with a single-fabric dryer section, the web is supported firmly against the drying fabric, by means of vacuum rolls and blow-boxes. This gives no opportunity for the release of the cross-direction tension in the web. Thus, the inelasticity of the web caused by the unsuitable moisture level often results in the web splitting in the cross or long direction when it is being cut and spread, thus lengthening the duration of the break.

Nowadays, to permit successful tail threading, the moisture percentage of the paper is increased during tail threading, by reducing the steam pressure in the dryer cylinders. This creates the flexibility and elasticity in the paper, which are required for successful tail threading. Once the web has been successfully spread onto the finishing device, the steam pressures in the dryer cylinders are increased to their production values. The cooling of the dryer cylinders and the return of their pressures to production levels make this an operation that creates further delays, resulting in a great deal of bottom-end and break rejects and a loss of production time.

Document FI-104337 discloses a wetting device in which, with the threading tail covered, the wetting device wets the threading tail. The position of the wetting device is described as being the end of the dryer section, in which it located is after the cutting point. Though the wetting of the tail will enhance its strength in the tail threading, it will not eliminate the problem of bursting, which will appear at the spreading phase.

Another document describing the prior art is FI-88813. This describes a solution which wets only the cutting trail of the threading tail in the case of bias-cutting. The device is situated before the cutting blade.

Further, the document U.S.-5862608 is known, which describes a solution based on the cooling of the dryer cylinders and through that achieves an increase in the moisture content of the paper web. The dryer cylinders are cooled by wetting the dryer wires. Every dryer group must have own device. The described solution has a certain delay, before there is an effect on the web moisture.

SUMMARY OF THE INVENTION

The present invention provides a method and arrangement by means of which the moisture content of the paper can be increased to a suitable level (4–8% , preferably 5–6%) essentially over the whole width of the web while threading the tail and spreading it, so that the equipment in the dryer section can be kept operating continuously during production, at the values required by production.

More specifically, the method in tail threading in a paper machine, in which the paper web is dried in production by means of a plurality of dryer groups consisting of a dryer section, and in which tail threading the threading tail is cut, taken as wetted to the finishing device, and spread to its full width for production, and in which method, before the threading tail is taken to the finishing device, the dryer section is kept in the settings of production operation or is set to otherwise correspond to production, except that a wetting process is started, in which the web is wetted at the full width for the duration of the tail threading, essentially before its cutting, to achieve an even moisturizing effect, and the wetting process is stopped after web is being spread.

An arrangement in a paper machine, which includes a multi-stage dryer section, threading tail cutting devices, a finishing device, and devices to take the threading tail to the finishing device, and possible rewetting devices, is characterized in that the arrangement includes full width wetting devices on the middle of the dryer section before cutting devices and which are arranged to wet the web, essentially over its full width, for the duration of the tail-threading phase.

The spraying of water onto the paper is a considerably more immediate measure than the previous method, because the web is at once either moister when the spray valve is open or drier when the spray valve is closed. When the wetting-spray is opened during a break, bottom-end and/or break rejects during the delay in the change in the steam pressure in the dryer-cylinder are entirely eliminated. If the wetting-spray is dimensioned according to the operation speed of the machine and the grammage, a wetting window can be accepted, in which the same wetting creates a moisture content of 8% in smaller grammages and a moisture content of 6% in larger grammages, at the same machine speed.

In the following, the invention is disclosed in detail, with reference to the accompanying drawings, which show a paper machine and the location of the wetting device in it.

These and other features and advantages of the invention will be more fully understood from the following detailed description of the invention taken together with the accompanying drawings.

DETAILED DESCRIPTION OF THE INVENTION

Figure 1:
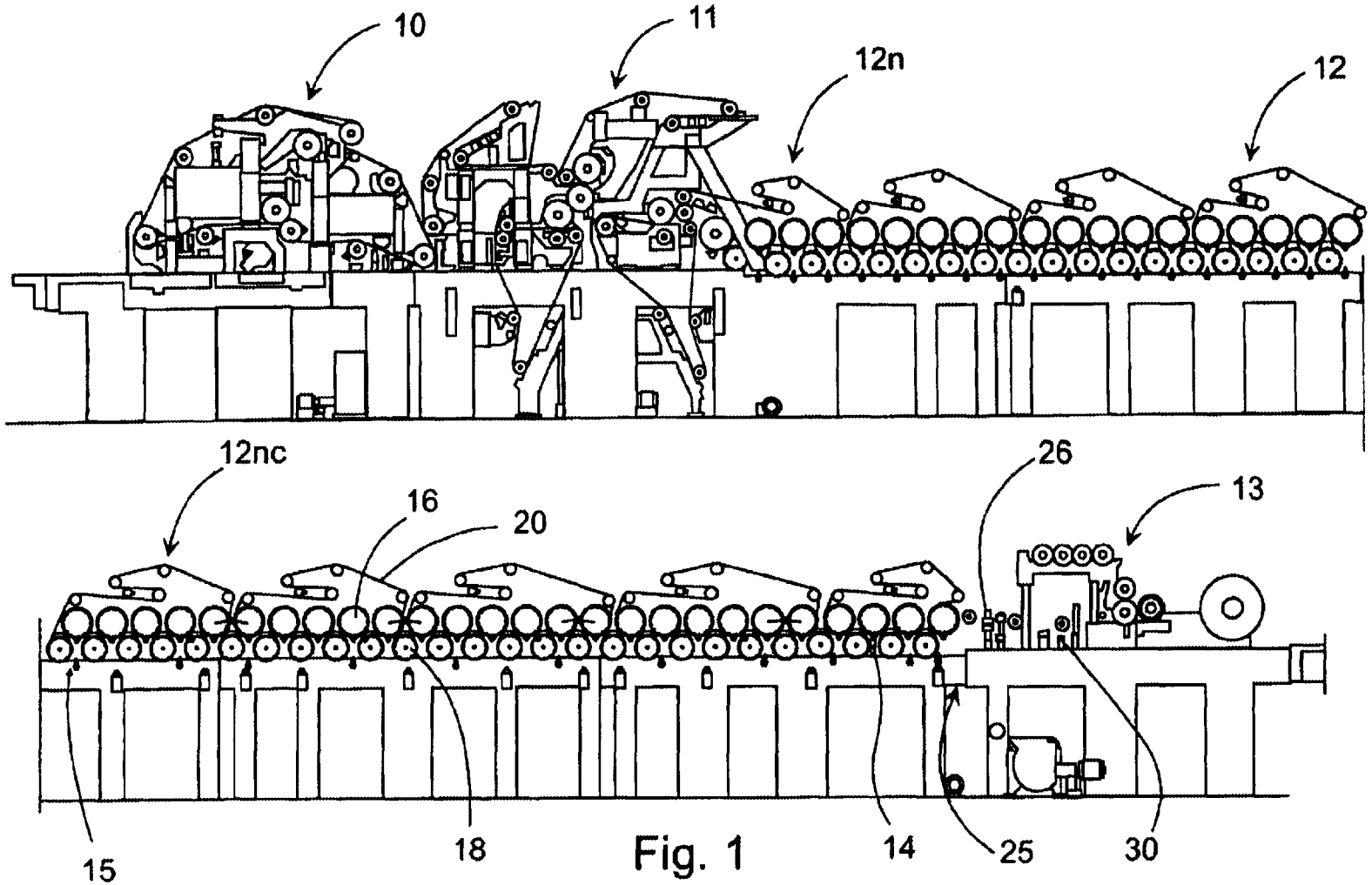
FIG. 1 shows a diagrammatic view of a paper machine.

Referring now to the drawings in detail, FIG. 1 shows a certain paper machine in a diagrammatic view according to the invention. The machine comprises a web-formation section 10, a press section 11, a multi-stage dryer section 12, and a finishing device 13, which in this case is a reeler. The finishing device 13 can be also a coating device, a sizer, a calender, or a post-dryer section which follows these.

The dryer section 12 includes dryer cylinders 16, vacuum rolls 18, dryer fabrics 20 supporting the web, and bias-cutting devices 14. Usually, the dryer section 12 is divided into dryer groups 12*n* divided by the fabric 20 where the amount of dryer groups 12*n* in overdried paper machines is typically 6–9. Each of the dryer groups 12*n* includes 4–6 dryer cylinders 16. The rewetting devices 30 for evening the moisture profile are located, for example, at the end the of dryer section 12 or just before the finishing device 13. The rewetting devices 30 are used to fix the moisture profile during production. The cutting devices 14 of the threading tail are positioned typically end of the dryer section 12 or end of the post-dryer section (not presented), for example, in such a way that there are still 2–4 dryer cylinders 16 after them.

In FIG. 1 the location of the full width wetting device according to the invention is marked with the reference number 15. In this case, the wetting device 15 is located at the 19th dryer cylinder of the middle dryer group 12*nc*. Tail threading devices, which can be based on vacuum pressure or blowing, or on both, are located between the dryer section 12 and the finishing device 13.

Figure 2:
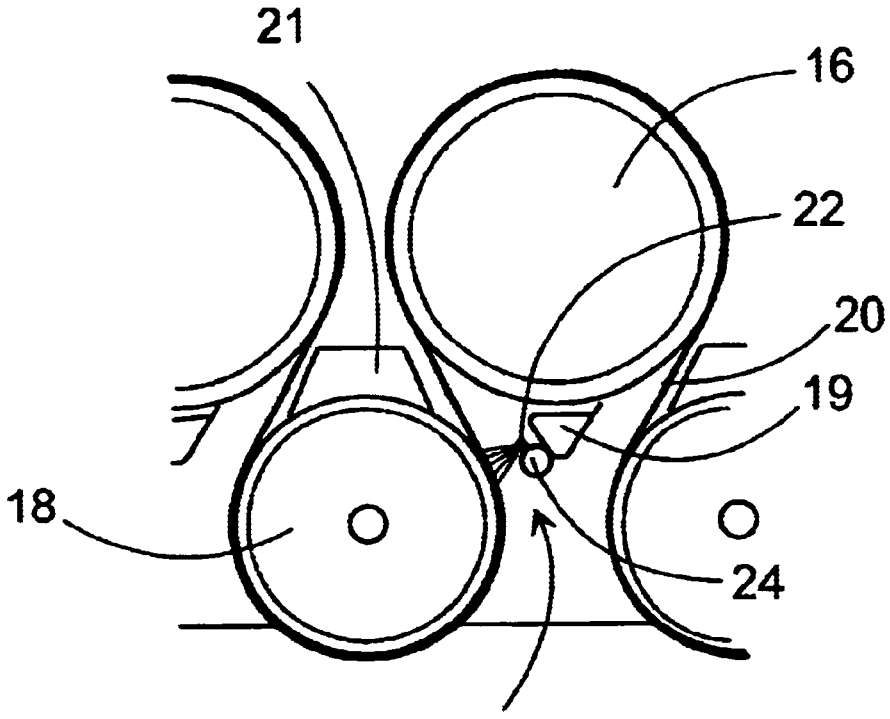
FIG. 2 shows a partial view of the installation of a wetting device according to the invention in a paper machine.

FIG. 2 shows a partial view of the dryer section 12 of the paper machine. The movement of the paper web through dryer section 12 is supported by fabric 20, blow boxes 21 situated between the cylinders 16, and vacuum rolls 18. Doctor devices 19, which are situated underneath cylinders 16, are used to keep the dryer cylinders 16 clean.

In the middle of the dryer section 12, a wetting device 15 is attached in front of the frame of the doctor 19. The doctor is preferably a hose loaded DST doctor, because this has the greatest doctoring precision. If a web break is caused by the water spray of the wetting device 15 and the web has adhered to the cylinder 16, a DST doctor will scrape the web off better than a traditional doctor and guide it away more safely from the surface of the cylinders into the pulper level in the basement.

It is preferable to locate the wetting device 15 in the middle dryer group 12*nc* or either of these, if the number of dryer groups is even. In any event, the wetting device 15 must be located essentially before the last dryer group of the dryer section 12, as the wetting, which is critical for the tail-threading event, must have time to be absorbed and spread evenly through the web, before the web reaches the end of the dryer section 12. On the other hand, wetting must not happen too early, as the web may then adhere to a dryer cylinder 16.

The wetting device 15 is formed by a tubular bar 24 which extends over the full width of the web, with nozzles 22 installed in it. A tubular bar 24 is attached to the frame of doctor 19. In the tubular bar 24, there are nozzles 22 of a specific size, at a suitable distance to each other. In one pilot test, a 25 mm tube was used in the wetting device 15, which tube was equipped with alternately located vee-jet 9503 and vee-jet 9504 nozzles at 170 mm intervals and at a distance of 280 mm from the web. The diameters of the nozzles are 1,1 mm and 1,3 mm (spraying angle 95 degree) hence the wetting device 15 is a considerably cruder arrangement than the rewetting devices 30 at the end of dryer section 12, which will affect the moisture profile without essentially changing the moisture level of the web. Nozzles 22 are located in the upper edges of the tubular bar 24, so that the apparatus will remain full of liquid after the valve is closed and the water pressure will be at the required level immediately the valve is reopened. The nozzles 22 of the wetting device 15 are aimed at the web as it travels upwards, in other words, in front of the doctor 19. The wetting area of the wetting device 15 in the cross direction of the paper machine corresponds essentially with the width of the paper web. The wetting can decrease or drop off at the edge areas of the web, because shrinking tensions are not a problem there.

The on/off valve of wetting device 15 is completely automated and is arranged to be controlled by the machine's control system, depending on the state of the automatic tail threading and break systems. The opening of the valve can be made dependent on the break detection or on the cutting/threading event of the threading tail and its closing, for example, on the moisture measurement 26 or on the detection of the full width web which has been spread to the finishing device 13. Fresh warm water at a pressure of 3 bar (generally 2–5 bar) can be used for wetting.

The invention operates as follows. If a break occurs in the paper machine, the web must be tail-threaded at the reject point 25 preceding the break point. Tail threading will happen in the customary way, in which the threading tail is cut with the bias-cutting device 14, taken to the finishing device 13 with the aid of tail threading devices, and spread to its full width with the bias-cutting device 14.

The steam pressure in the cylinders 16 of the dryer section 12 is maintained at the production values for the whole time. In one preferred embodiment, in which the tail threading will take place by the machine operator essentially in two phases, the machine operator will first determine the cleanness of the dryer section 12. After this, he will order the control system of the paper machine to start the tail threading process. Prior to that, the machine control system will have started the cutting and take-up sequence of the threading tail, the wetting of the paper web being begun in the middle of the dryer section 12, using the devices according to the invention.

Next, tail threading from the dryer section 12 to the finishing device 13 is started by cutting the threading tail, for example, with a double water cutter 14, which has been installed at the end of the dryer section 12 and preferably in the middle of the machine in the cross-machine direction. The cut threading tail is taken at the same time to the finishing device 13, after which the machine operator will order the control system of the paper machine to spread the web to the full width. Wetting is continued for long enough until the web=s threading tail has been successfully blown, or otherwise taken onto the finishing device 13 and spread quickly with the double cutter 14 to its full width to both the tending side and drive side. Wetting is stopped, once the web has been, or is being spread.

Another preferred embodiment involves performing tail threading as a totally automatic sequence of events. In that case, once the machine operator has determined the cleanness of the dryer section 12, he orders the control system of the paper machine to essentially automatically perform the described wetting, cutting and taking of the threading tail, and the web spreading operations.

Thus, the whole sequence of events is arranged to take place essentially automatically, in which case the spreading of the web to its full width begins immediately after the convenient moisture level of the web has been reached. In practice, this will happen with a very small delay or almost immediately at the start of the wetting, because of the high machine speed, and is therefore also evaluated by the machine operator in the said first embodiment. The convenient moisture level can also be detected, for example, with the aid of the temperature of the web, which correlates with the moisture level. The temperature detection takes place e.g. at the reject point 25 after the dryer section 12, where devices 26 are adapted for this purpose. Other measurement procedures can also be used.

The invention has been described above in the case of reeler tail threading. The wetting described in this invention is, however, always applied when the moisture level of the web must be raised for the duration of tail threading, for example, when tail threading to the coating device, sizer, or calender, or post-dryer section. It is essential that the web is wetted over its full width or almost its full width before the cutting of the threading tail is started and that wetting will take place in the machine direction essentially before the cutting point. Except for the wetting, the whole tail threading will take place essentially with the same settings as are used during the production. The re-wetting will stop once the tail threading has been completed, or during the end phase of the tail threading.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method in tail threading in a paper machine, in which the paper web is dried in production by means of a plurality of dryer groups consisting of a dryer section, and in which tail threading the threading tail is cut, taken as wetted to a finishing device, and spread to its full width for production, and in which method, before the threading tail is taken to the finishing device, the dryer section is kept in the settings of production operation or is set to otherwise correspond to production, except that a wetting process is started, in which the web is wetted at the full width for the duration of the tail threading, essentially before its cutting, to achieve an even moisturizing effect, and the wetting process is stopped after web is being spread.

2. A method according to claim 1, characterized in that the wetting takes place in the middle of the dryer section.

3. A method according to claim 1, characterized in that the moisture content of the paper web is raised to 4–8%.

4. An arrangement in a parer machine, which includes a multi-stage dryer section, threading tail cutting devices, a finishing device, and devices to take the threading tail to the finishing device, and possible rewetting devices, characterized in that the arrangement includes full width wetting devices on the middle of the dryer section before cutting devices and which are arranged to wet the web, essentially over its full width, for the duration of the tail-threading phase and a control for controlling the wetting devices according to a tail threading sequence.

5. An arrangement according to claim 4, characterized in that the wetting devices are located in the middle of the dryer section.

6. An arrangement according to claim 4, characterized in that at least one wetting device is formed from a tubular bar extending over the whole web, nozzles located in it, and a valve controlling the flow.

7. An arrangement according to claim 6, characterized in that the nozzles of the wetting device are installed in the upper edge of the tubular bar.

8. An arrangement according to claim 6, characterized in that the valve of the wetting device is arranged to be controlled automatically by the machine's control system.

9. An arrangement according to claim 4, characterized in that there is a detecting device for detecting the moisture level of the web at the reject point after the dryer section.

10. An arrangement according to claim 8, characterized in that the machine's control system is adapted to control the said wetting and the said tail threading in an automatic sequence.

11. An arrangement according to one of claim 4, characterized in that the wetting device is attached to the frame of the doctor.

12. An arrangement according to claim 11, characterized in that the wetting device is aimed at the paper web as it travels upwards, in front of the doctor.

13. An arrangement according to claim 4, characterized in that the said finishing device is one of a reeler, a sizer, a coating device, a calender, and a post-dryer section.

* * * * *